United States Patent [19]

Kohyama et al.

[11] Patent Number: 4,645,330

[45] Date of Patent: Feb. 24, 1987

[54] ELECTROPHOTOGRAPHIC DEVICE

[75] Inventors: Mitsuaki Kohyama, Tokyo; Toshihiro Kasai, Yokohama; Haruhiko Ishida, Tokyo; Takashi Shimazaki, Kawasaki, all of Japan

[73] Assignee: Kabushiki Kaisha Toshiba, Kawasaki, Japan

[21] Appl. No.: 627,299

[22] Filed: Jul. 2, 1984

[30] Foreign Application Priority Data

Jul. 5, 1983 [JP] Japan ..... 58-121776

[51] Int. Cl.[4] ..... G03G 15/00

[52] U.S. Cl. ..... 355/14 R; 355/3 R; 355/4; 118/658; 430/55

[58] Field of Search ..... 355/4, 14 R, 3 R; 118/645, 658; 430/42, 55

[56] References Cited

U.S. PATENT DOCUMENTS

| | | | |
|---|---|---|---|
| 4,189,224 | 2/1980 | Sakai | 355/4 |
| 4,308,821 | 1/1982 | Matsumoto et al. | 355/4 |
| 4,392,737 | 7/1983 | Nishikawa . | |
| 4,413,899 | 11/1983 | Karasawa et al. | 355/14 R |

OTHER PUBLICATIONS

German Office Action and English translation thereof.

Patents Abstracts of Japan, Jun. 11, 1983, vol. 7, No. 134, p. 203.

Patents Abstracts of Japan, Apr. 12, 1983, vol. 7, No. 87, p. 190.

*Primary Examiner*—Arthur T. Grimley

*Assistant Examiner*—David S. Warren

*Attorney, Agent, or Firm*—Cushman, Darby & Cushman

[57] ABSTRACT

An electrophotographic device is provided with a photosensitive drum having a plurality of photosensitive layers which are different from one another in spectral sensitivity. First and second uniform exposure devices are adjacent to each other about the photosensitive drum. Each of the first and second uniform exposure devices includes a plurality of single color light sources. The light sources of the first exposure device have a different color than the light sources of the second exposure device. The colors correspond to the spectral sensitivity of each of the photosensitive layers, and are used as the uniform exposure light source for the photosensitive drum.

4 Claims, 19 Drawing Figures

ELECTROPHOTOGRAPHIC DEVICE

BACKGROUND OF THE INVENTION

The present invention relates to an electrophotographic device such as the laser printer and, more particularly, it relates to an electrophotographic device provided with a photosensitive body which has multi-photosensitive layers.

Generally, with respect to electrophotographics, a copy is obtained by uniformly charging a photosensitive body and then image-exposing it to form an electrostatic latent image. The electrostatic latent image is developed by charged particles (or developer) and the developed image is transferred onto material such as a sheet of paper. Then the transferred image is fixed on the transferring material by heating. In the case of this type electrophotographic device, the stability of the photosensitive body, which is used repeatedly, is important.

In this application, the primary component of stability is the stability of photoconductivity. The stability of images depends particularly upon how stable the electrostatic properties (e.g., charge potential and residual potential after irradiation) are when the photosensitive body is used continuously or with intervals.

The photosensitive body is usually subject to uniform exposure before it is charged to make the image stable. This procedure provides preparatory fatigue to the photosensitive body and eliminates any charge left when it is used repeatedly. This uniform exposure is performed with a device called either a pre-exposure lamp, erasing lamp or pre-fatigue lamp. When the properties of the photosensitive body are stabilized by this uniform exposure, particular consideration must be paid particularly to those photosensitive bodies which are easily fatigued.

A manner of stabilizing the fatigue of an arsenic/-selenium photosensitive body, for example, is disclosed in the Japanese Patent Disclosure Sho-53/148444. This document teaches that the initial variation of charge potential when the photosensitive body is used repeatedly may be held small by radiating the photosensitive body with light having a specific wavelength (a specific color), for the purpose, in particular, of strongly pre-fatiguing the photosensitive body prior to charging. A first green lamp and a second red lamp are provided to meet this purpose. In the copying mode, both the first and second lamps are turned on in the beginning and only the first lamp is kept on thereafter. The properties of the photosensitive body are stabilized by controlling the first and second lamps in this manner. In this case, the first green light is used for erasing the residual charges on the photosensitive body while the second red light is used just before the formation of the copy. The red light includes a wavelength of 620 nm by which the photosensitive body tends to be fatigued. Thus the first green light eliminates charge while the second red light provides pre-fatigue.

The stabilization of charge potential is also enhanced by gradually reducing the strengths of these uniform exposure lamps from the beginning of the copying cycle.

The above-described manner of stabilizing the electrostatic properties of the photosensitive body has not reached such a level yet that it can meet any change of environmental conditions such as temperature and humidity. It is suitable, however, in practical applications.

A selenium or silicon type photosensitive body is thought desirable which is sensitive to near infrared rays in the vicinity of 800 nm which is the wavelength of semiconductor lasers. An example of the selenium type is a Se/SeTe/Se/Al-based sensitive body and a Si-H-C/Si-H-Ge/Si-H-B/Al-based one is representative of the silicon type. Each has a multi-layer construction in which each layer is different from one another in spectral sensitivity. The reason why the photosensitive body has this multi-layer construction is, for example, that selenium/tellurium alloy is excellent in its sensitivity relative to the near infrared rays but abnormally quick in the dark decay of its charge. In order to cover the abnormal quickness of its dark decay, therefore, a layer of amorphous selenium (Se) or a layer made by adding a little amount of tellurium, antimony or arsenic is coated on it. Also in the case of an amorphous silicon photosensitive body, its construction is often of the multi-layer type for the same reason.

It was reported by A. R. Melnyk and others in "A Layered Se-Te Photoreceptor For A GeA As Laser Printer" at the "First International Congress On Advance In Non-Impact Printing Technologies" held by SPSE in June, 1981 that property deterioration of those photosensitive bodies which are sensitive to long wavelengths could be prevented by this multilayer construction. A method of manufacturing photosensitive bodies having superposed layers of Se-Te and Se-Te-Sb on a conductive support is disclosed in the Japanese Patent Disclosure Sho-56/151941.

Further, the amorphous silicon photosensitive body whose sensitivity relative to long wavelength has been increased by germanium is described in detail in the Japanese Patent Disclosure Sho-57/78183, for example.

Photosensitive bodies which had fundamentally the same construction have been manufactured on a trial basis. As the result, it has been found that their sensitivity relative to long wavelength can be enhanced, but that their electrostatic properties become extremely more unsatisfactory as compared with the conventional photosensitive bodies because of increase of persistent residual potential at the time of their being used continuously and because of large reduction of charge acceptance at the time of high temperature. These drawbacks are difficult to solve to meet practical purposes, and the electrophotographic devices using the photosensitive bodies of this type have not been practiced yet or have been provided as samples which can be used only under limited conditions.

SUMMARY OF THE INVENTION

The present invention is therefore intended to eliminate the above-mentioned drawbacks, for example, reduction of charge potential, increase of residual potential when being used continuously, and large reduction of charge at high temperatures. Thus the present invention is an electrophotographic device capable of stabilizing the properties of a photosensitive body.

In the present invention an electrophotographic sensitive body has a plurality of photosensitive layers which are different from one another in spectral sensitivity. A uniform exposure means, in which a plurality of single color light sources each having a different color corresponding to the spectral sensitivity of each of the photosensitive layers, is used as the uniform exposure light source for the electrophotographic sensitive body. The exposure means is arranged facing each of the different positions of the electrophotographic sensitive body.

BRIEF DESCRIPTION OF THE DRAWINGS

These and other objects and advantages of the present invention will become apparent and more readily appreciated in the following detailed description of the presently preferred embodiments, taken in conjunction with the accompanying drawings, of which.

DETAILED DESCRIPTION OF THE PREFERRED EMBODIMENTS

One embodiment of the electrophotographic device according to the present invention will be described in detail referring to FIGS. 1 through 7B.

Figure 1:
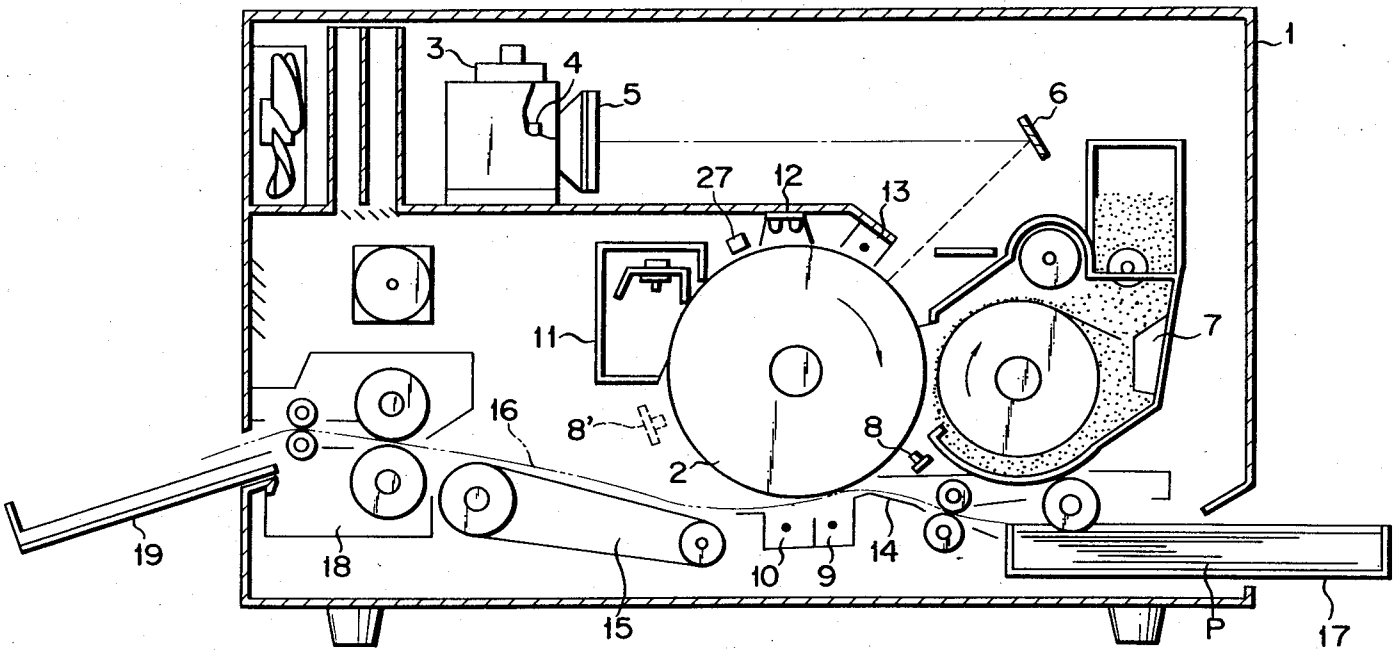
FIG. 1 is a sectional view schematically showing a laser printer as the electrophotographic device of one embodiment of the present invention.

FIG. 1 shows a laser printer which serves as the electrophotographic device. In FIG. 1, numeral 1 represents a body of the laser printer. A photosensitive drum 2 which serves as the electrophotographic sensitive body is supported, rotatable in the clockwise direction, substantially in the center of body 1. An image exposing unit 3 is arranged at the upper portion in body 1. This image exposing unit 3 includes a laser beam source (not shown), rotatable polygonal mirror 4, imaging lens 5, mirror 6 and the like. The laser beam, modulated according to image information, is radiated on photosensitive drum 2. Arranged around photosensitive drum 2 along its rotating direction (or clockwise direction) are a developing unit 7, first uniform exposing unit 8, transferring corona charger 9, peeling-off corona charger 10, blade cleaner 11, second uniform exposing unit 12 and electrifying corona charger 13.

A conveying path 16 for transfer papers P, which includes a guide 14, conveying belt 15 and the like is provided at the lower portion in body 1. Transfer paper P, fed from a paper supply cassette 17, is conveyed between photosensitive drum 2 and transferring charger 9, between photosensitive drum 2 and peeling-off charger 10, and then through a fixing heat roller unit 18 to a paper discharge tray 19.

Figure 2:
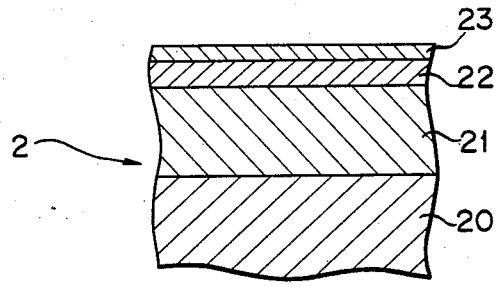
FIG. 2 is a sectional view showing a part of the photosensitive drum of FIG. 1.
Figure 3:
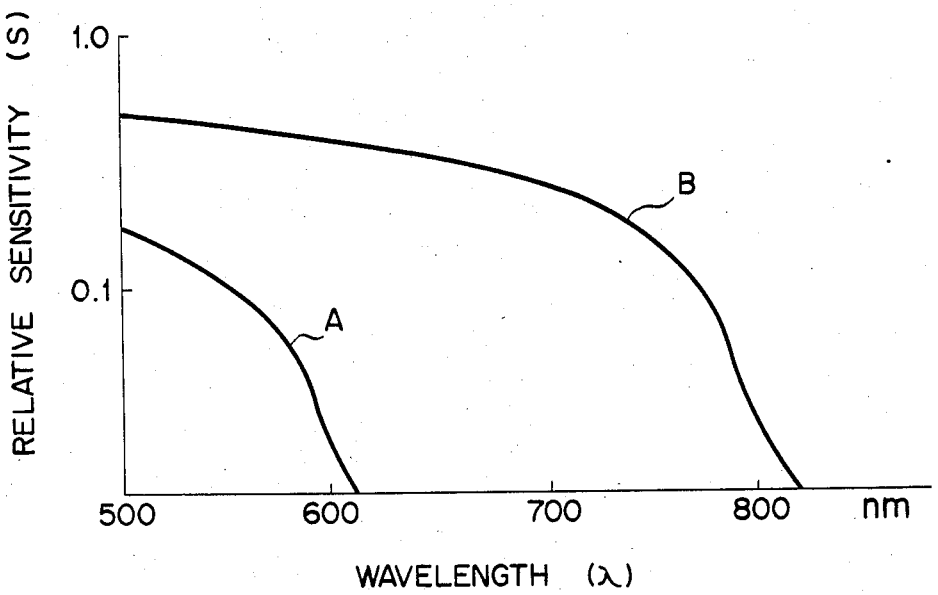
FIG. 3 is a chart showing the relative spectral sensitivities of each layer of the photosensitive body.

Photosensitive drum 2 is of selenium type having SeTeSb/SeTe/Se/Al-based multi-layers. As shown in FIG. 2, photosensitive drum 2 comprises a cylindrical aluminium base 20, an amorphous selenium layer (about 50 μm thick) 21 coated on base 20, a selenium-tellurium alloy layer (2 μm thick and the concentration of tellurium is about 40%) 22 coated on amorphous selenium layer 21, and a selenium-tellurium-antimony layer (about 2 μm thick) 23 coated on selenium-tellurium alloy layer 22. The relative spectral sensitivity S of each of these layers is as shown in FIG. 3. Selenium-tellurium layer 22 has a higher sensitivity (curve B) which extends to a longer wavelength than that of the selenium-tellurium-antimony layer 23 (curve A).

Figure 4:
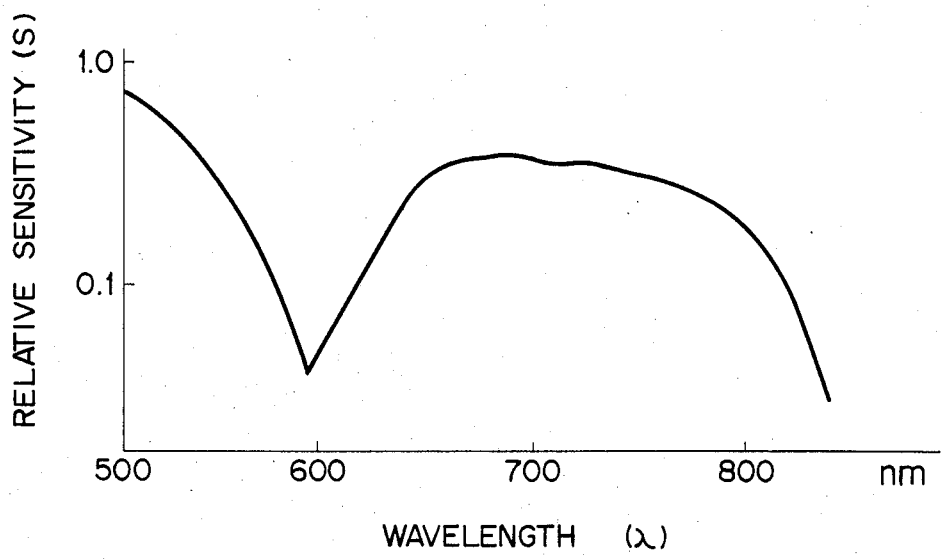
FIG. 4 is a chart showing the total relative spectral sensitivity.

The total spectral sensitivity S of photosensitive drum 2 obtained by superposing these layers 21, 22 and 23 upon each other is as shown in FIG. 4. As is apparent from FIG. 4, deterioration of sensitivity occurs in the vicinity of a wavelength of 600 nm, since light in the vicinity of this wavelength is absorbed by surface layer 23 of selenium-tellurium-antimony, but without generation of carriers for contributing photoconductivity. In addition, practically no light reaches selenium layer 21. Therefore, selenium layer 21 does not contribute to the sensitivity directly; but light is absorbed by both selenium-tellurium-antimony (Se-Te-Sb) layer 23 and selenium-tellurium (Se-Te) layer 22, which serve as layers for generating carriers. Accordingly, it is selenium-tellurium-antimony (Se-Te-Sb) and seleniumtellurium (Se-Te) layers 23 and 22 of these three photosensitive layers that contribute to photoconductivity. Se layer 21 works as a charge transport layer.

Photosensitive drum 2 is light-irradiated by second uniform exposing means 12, rotating at a peripheral speed of 180 mm per second in the clockwise direction, and then uniformly electrified by electrifying corona charger 13 to have a surface potential of about 600 V. The laser beam, modulated by an image signal, is horizontally scanned by rotatable polygonal mirror 4 and radiated, as a light beam of about 780 nm, onto the uniformly charged photosensitive drum 2 through imaging lens 5. A desired electrostatic latent image is thus formed on photosensitive drum 2.

The electrostatic latent image on photosensitive drum 2 is then developed with toner as a visible image through the well-known magnetic brush developing unit 7. Photosensitive drum 2, on which the toner (or visible) image has been formed, is light-radiated by first uniform exposing unit 8 to erase the latent image. Thereafter, transfer paper P is fed between photosensitive drum 2 and transferring corona charger 9 in close contact with photosensitive drum 2.

Charge having a polarity opposite to that of the visible image on photosensitive drum 2 is applied from transferring corona charger 9 to transfer paper P to transfer the toner image on photosensitive drum 2 to transfer paper P. An AC voltage of about 400 Hz is then applied by peeling off corona charger 10 to discharge charged paper P, thereby enabling transfer paper P to be peeled off from photosensitive drum 2. Transfer paper P thus peeled off is fed to fixing heat roller unit 18 by conveying belt 15 to fix the toner image onto transfer paper P. Thereafter, transfer paper P is discharged into paper discharge tray 19, thereby completing one cycle of the copying operation.

Any toner left on photosensitive drum 2 after the toner transfer operation is scraped off by blade cleaner 11. This cleaning operation is finished after repeating it a desired number of copy times under electrical control.

Figure 5A:
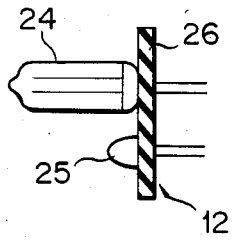
FIGS. 5A and 5B are a sectional view and a side view showing a second uniform exposure device according to the first embodiment, respectively.
Figure 5B:
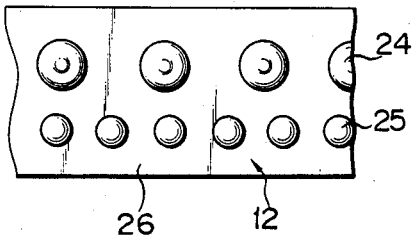
Figure 6A:
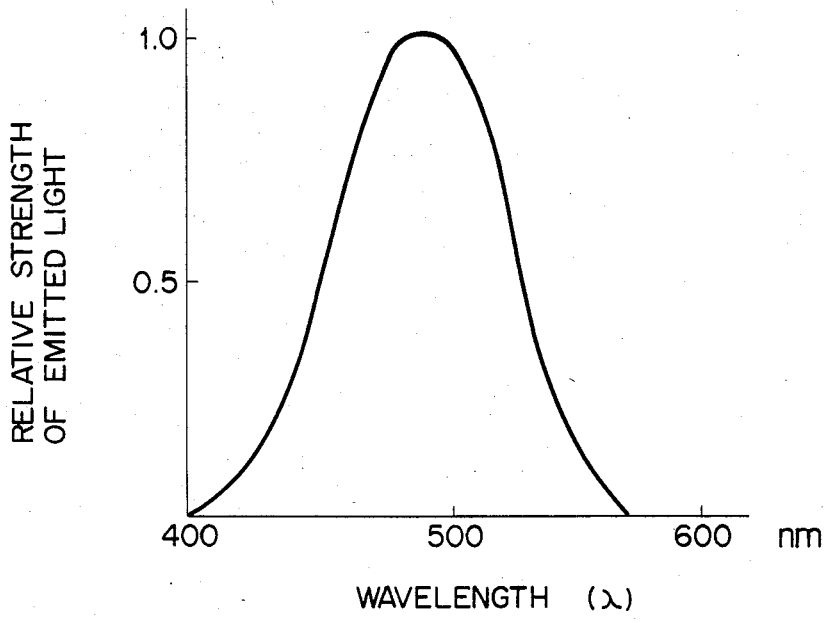
FIGS. 6A and 6B are charts showing spectroradiation characteristics of a fluorescent green glow lamp and LED, respectively.
Figure 6B:
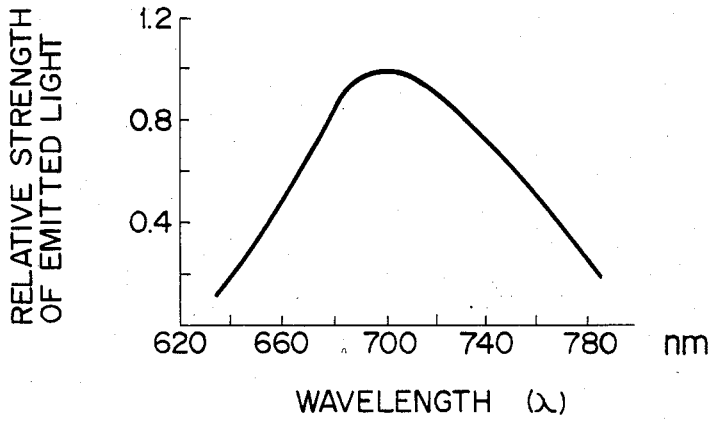

Second uniform exposure unit 12 includes an integral arrangement of single color light sources, as shown in FIGS. 5A and 5B, and is located opposite to photosensitive drum 2 of the selenium type. Exposure unit 12 is to be distinguished from the conventional exposure unit which employed white light sources or a single color light source such as green or blue. Exposure unit 12 includes, for example, a plurality of blue fluorescent glow lamps (NL-22/B made by ELBAM) 24 each having a spectral radiation distribution as shown in FIG. 6A, and a plurality of LEDs (TLR 101 made by Toshiba) 25 each having a spectroradiation distribution as shown in FIG. 6b. Glow lamps 24 and LEDs are arranged on the same base plate 26. As already shown in FIG. 3, each of lamps 24 and 25 has a wavelength which makes only one of the photosensitive layers 22 and 23 sensitive.

The following tests were done under the arrangement as described above:

(1) Environmental temperature conditions: 10° C., 25° C., 40° C.

(2) Light sources for the second uniform exposure unit:

(a) Tungsten lamps (white) turned on.

(b) Fluorescent glow lamps (blue) 24 and LEDs (red) 25 turned on at the same time.

(c) Only the fluorescent glow lamps 24 turned on.

(d) Only the LEDs 25 turned on.

(3) Amount of light radiated for uniform exposure: 60 erg/cm$^2$ (4) Matters measured:

(a) Change of charge potential.

(b) Change of residual potential (after radiation of the laser beam at 40 erg/cm$^2$).

(c) Change of the both potentials after continuous copying operation of 100 cycles.

Since a total of twelve different conditions were tested, citation of measured data is omitted, but can be summarized as follows:

(a) With the tungsten lamps, the charge potential lowers more than 200 V at 40° C. after continuous copying operation of 100 cycles. No significant change can be found at 10° C. and 25° C. The residual potential increased by 30 V - 50 V at 40° C.

(b) With fluorescent glow lamps 24 and LEDs 25 turned on at the same time, a trend similar to that with the tungsten lamps can be found.

(c) With only fluorescent flow lamps 24 turned on, the residual potential increases by 80 V - 100 V both at 10° C. and 25° C., but the fall of the charge potential at 40° C. is less than 100 V.

(d) With only LEDs 25 turned on, the charge potential falls by 150 V - 200 V at 40° C., but the increase of the residual potential at 10° C. and 25° C. was small, about 50 V.

To minimize the change of both charge and residual potentials over the temperature range of from 10° C. to 40° C., the conventional selection of wavelength and strength of the uniform exposure lamps is not efficient and that changeover of wavelength radiated is effected.

Figure 8:
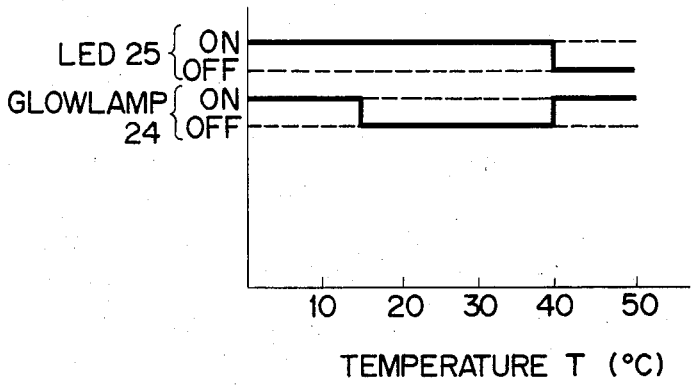
FIG. 8 is a timing chart showing a driving timing for the second uniform exposure device.

In order to always meet all of the above-mentioned results, the second uniform exposing means 12 provided with the fluorescent glow lamp 24 and LED 25 each of which is a single light source is controlled to turn ON and OFF, responsive to results detected by a temperature detector 27 which detects the circumferential temperature of photosensitive drum 2. 15° C. (first temperature) and 40° C. (second temperature) are selected as reference temperatures, and a temperature region lower than 15° C. is defined as a low temperature region, the one between 15° C. and 40° C. a middle temperature region, and the other one higher than 40° C. high temperature region. As shown in FIG. 8, glow lamp 24 and LED 25 are selectively turned ON, depending on which temperature region the temperature detected by temperature detector 27 belongs to, and the photosensitive layers are made active under optimum condition all over the temperature regions.

Figure 7:
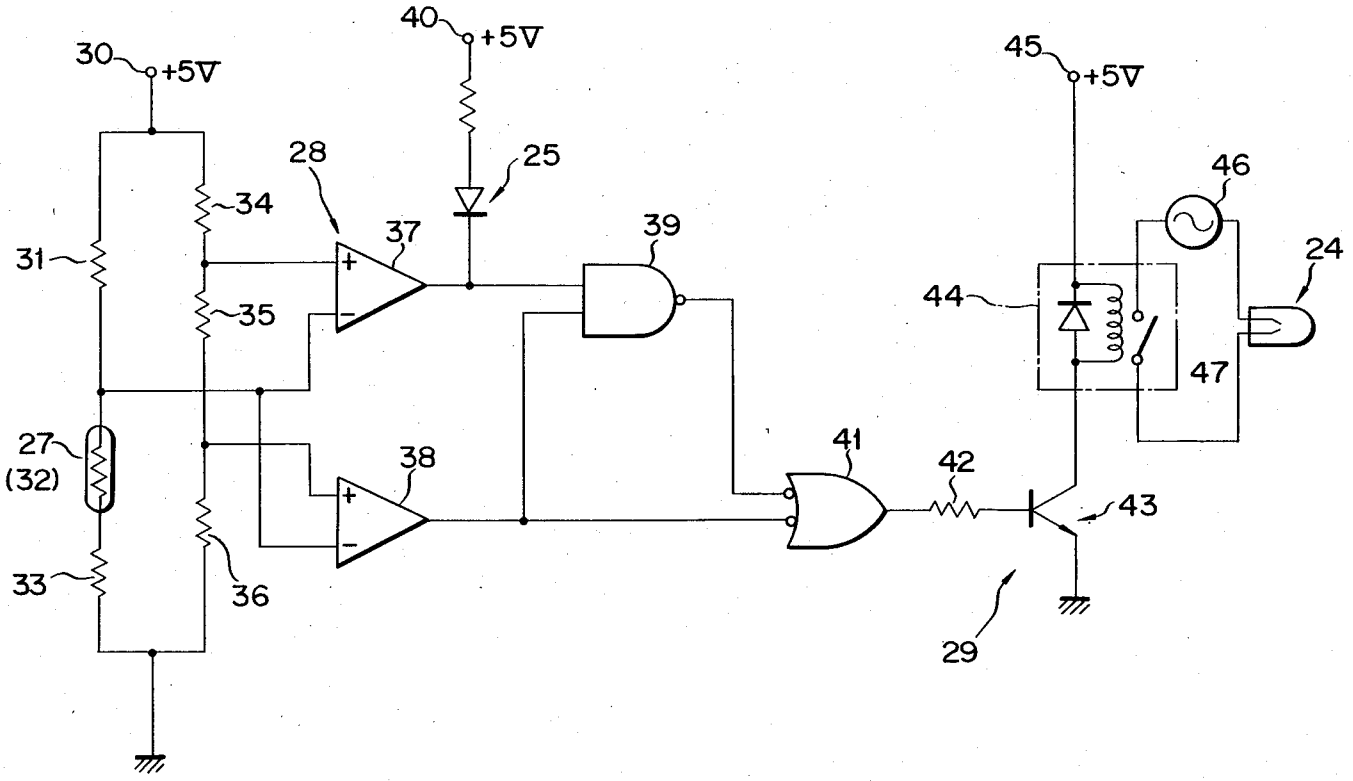
FIG. 7 is a circuit diagram showing driving and controlling systems for a glow lamp and LED.

A control system 28 and a driver system 29 for this purpose will be described referring to FIG. 7. First, second and third resistors 31, 32, 33 are connected in series between a first power input terminal 30 of +5V and an earth, and fourth, fifth and sixth resistors 34, 35, 36 are also connected in series but parallel to the serial circuit of resistors 31, 32, 33 between power input terminal 30 and the earth. The second resistor 32 is a thermistor which serves as the above-described temperature detector 27.

A connecting terminal common to first and second resistors 31, 32 is connected to inverted input terminals of first and second operational amplifiers 37, 38. A connecting terminal common to fourth and fifth resistors 34, 35 is connected to a non-inverted input terminal of first operational amplifier 37, and a connecting terminal common to fifth and sixth resistors 35, 36 to a non-inverted input terminal of second operational amplifier 38. The above-mentioned first and second reference temperatures can be selected by appropriately setting resistance values of first, third, fourth to sixth resistors 31, 33 to 36.

When the temperature in the vicinity of photosensitive drum 2 is at the low temperature region, the resistance value of second resistor 32 is made large and first and second operational amplifiers 37, 38 output "L" level signals. When the temperature in the vicinity of photosensitive drum 2 is at the middle temperature region, the resistance value of second resistor 32 is made medium, and first operational amplifier 37 outputs an "L" level signal while second operational amplifier 38 outputs an "H" level signal. When the temperature in the vicinity of photosensitive drum 2 is at the high temperature region, first and second operational amplifiers 37, 38 output "H" level signals.

The output terminal of first operational amplifier 37 is connected to the cathode of LED 25 and an input terminal of a first NAND gate circuit 39. The anode of LED 25 is connected to a second power input terminal 40. The output terminal of second operational amplifier 38 is connected to another input terminal of first NAND gate circuit 39 and an input terminal of a second NAND gate circuit 41. The output terminal of first NAND gate circuit 39 is connected to another input terminal of second NAND gate circuit 41.

The output terminal of second NAND gate circuit 41 is connected to the base terminal of an npn type transistor 43 through a resistor 42. The emitter terminal of transistor 43 is earthed and the collector terminal thereof is connected to a control terminal of a relay circuit 44. Another control terminal of relay circuit 44 is connected to a third power input terminal 45. Fluorescent glow lamp 24 is connected to a switch 47 of relay circuit 44 through an AC power source 46 of 100 V.

Control system 28 comprises first, third to sixth resistors 31, 33–36, and first and second operational amplifiers 37, 38, while driver system 29 first, second NAND gate circuits 39, 41, transistor 43, and relay circuit 44.

Since control and driver systems 28, 29 are arranged like this, "L" level signals are outputted from both of first and second operational amplifier 37, 38, when the temperature detected is at the low temperature region. Therefore, current is supplied from second power input terminal 40 to LED 25 to turn on the latter. On the other hand, "L" level signals are applied to first NAND gate circuit 39, which therefore outputs an "H" level signal. "H" and "L" level signals are applied to second NAND gate circuit 41, which outputs an "H" level signal. Therefore, transistor 43 is made conductive to close the switch 47 of relay circuit 44. Fluorescent lamp 24 is thus turned on.

When the temperature detected is at the middle temperature region, an "L" level signal is outputted from first operational amplifier 37 and an "H" level signal is outputted from second operational amplifier 38. Therefore, LED 25 is kept lighted. On the other hand, "L" and "H" level signals are applied to first NAND gate circuit 39, which outputs an "H" level signal. "H" level signals are applied to second NAND gate circuit 41, which outputs an "L" level signal. Therefore, transistor 43 is made non-conductive to open switch 47. Fluorescent glow lamp 24 is thus turned off.

When the temperature detected is at the high temperature region, "H" level signals are outputted from both of first and second operational amplifiers 37, 38. Therefore, LED 25 is turned off. On the other hand, "H" level signals are applied to first NAND gate circuit 39, which outputs an "L" level signal. "H" and "L" level signals are applied to second NAND gate circuit 41, which outputs an "H" level signal. Fluorescent glow lamp 24 is thus turned on.

Change of charge potential, seen when tests employing the above-mentioned lightening mode were conducted under the temperature condition of from 10° C. to 40° C., is made lower than 100 V, and change of residual potential is also reduced to about 50 V. Apparent from the above, the picture quality obtained through the process of one embodiment of the laser printer device is improved to such a level that almost no change could be found about the picture quality. In a case where light having a wavelength which acts on spectral sensitivities of both photosensitive layers 22, 23 is radiated from this single color light source, for example, it was confirmed by other experiments that this effect could not be achieved.

The reason why change of charge and residual potentials of photosensitive drum 2 can be controlled by combining specified single color lights each having a wavelength color which makes only a specified photosensitive layer active is thought that selenium/tellurium/antimony (Se-Te-Sb) layer 23 which is the first layer of photosensitive drum 2 used is different from selenium/tellurium (Se-Te) layer 22 in fatigue to light. When a case where selenium/tellurium/antimony (Se-Te-Sb) layer 23 having a thickness of about 5μ is formed on a pure selenium layer, about 55μ thick, is compared with a case where selenium/tellurium (Se-Te) layer 22 is exposed as the surface layer, it has been found that selenium/tellurium (Se-Te) layer 22 shows more remarkable fall of charge potential at high temperature, and that the photosensitive layer consisting of only selenium/tellurium/antimony (Se-Te-Sb) layer 23 has a trend of easily increasing residual potential at low temperature. This leads us to the thought that drawbacks of both layers always come to appear when these layers are superposed one upon the other.

With this embodiment, therefore, change of charge potential is totally kept negligible by "exciting only a specified photosensitive layer (23) whose fatigue is small or which generates few free carriers while making the other photosensitive layers (22) inactive" depending upon temperature change. The above-mentioned effect can be more reliably achieved by using the layers complementally in such a way that "the layer 22 whose deep trap is small is excited while the other layers 23 are kept inactive". This embodiment of the present invention is intended to achieve the effect by skillfully combining the temperature dependency of photosensitive layers with the irradiated wavelength dependency thereof.

Although first exposure unit 8, which serves as the exposure lamp before the transferring process, is used to make it easy to peel off transfer paper P from photosensitive drum 2, also and to improve transfer of developed image, it is not necessarily needed when transfer paper P is mechanically peeled from photosensitive drum 2. In this case, trapped charge of the Se-Te layer cannot be removed only by blue light 24. When first uniform exposure unit 8' is located as shown by a broken line in FIG. 1, therefore, photosensitive drum 2 is less stabilized, but an extreme improvement can be achieved as compared with the conventional case. When first uniform exposure unit 8' is located as shown by the broken line in FIG. 1, cleaning ability can be improved secondarily because removal of charge is carried out before cleaner 11. Accordingly, this position shown by the broken line in FIG. 1 is a preferable one as long as fatigue of photosensitive drum 2 is allowable.

As described above, photosensitive drum 2 is provided with a plurality of photosensitive layers each having a different spectral sensitivity and second uniform exposing unit 12 is also provided with a plurality of single color light source or lamps 24, 25, corresponding to the photosensitive layers. In addition, these plural lamps are selectively turned on, depending upon the conditions under which photosensitive drum 2 is held, to thereby selectively irradiate the photosensitive layers. It can be thus realized that photosensitive drum 2 whose fatigue change is large is stably used.

A variation of the photosensitive drum in which amorphous silicon is employed as a photosensitive layer will be described.

Figure 9:
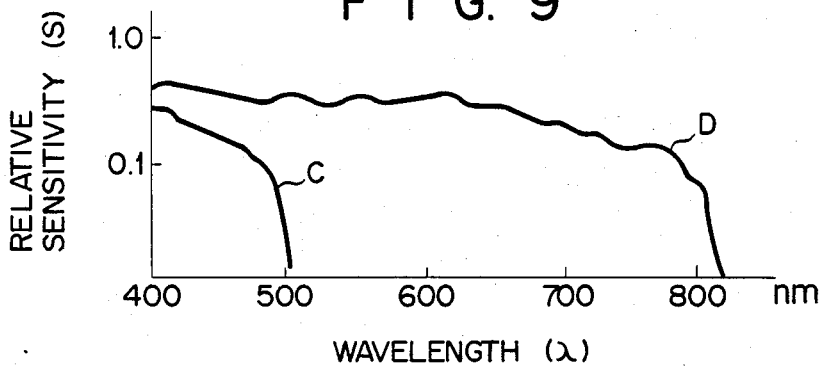
FIG. 9 is a chart showing the spectral sensitivities of a photosensitive body in which amorphous silicon is employed, in a second embodiment according to the present invention.
Figure 10:
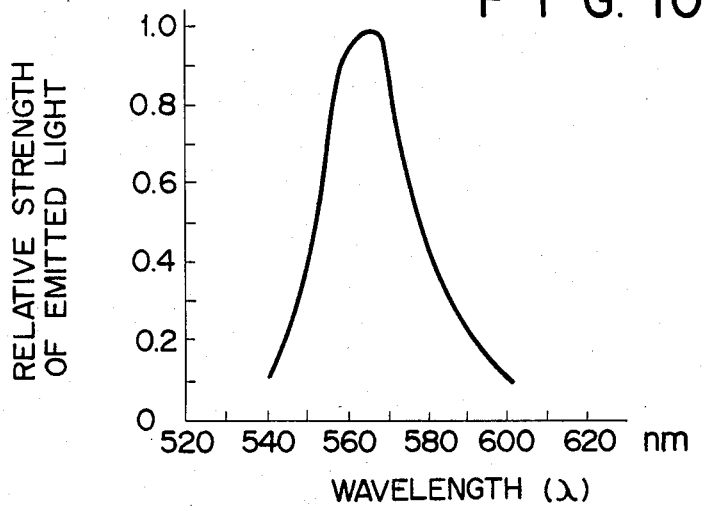
FIG. 10 is a chart showing the spectroradiation characteristic of an LED.

The spectral sensitivity of a Si-H-C layer which serves as the outermost layer of this photosensitive drum is represented by a curve C in FIG. 9 and that of a next Si-H-Ge layer by a curve D in FIG. 9. The spectral sensitivity of all photosensitive layers of the photosensitive drum has a curve substantially similar to curve D. With this photosensitive drum, dark decay tends to become quick particularly at higher temperatures and as a result, the charge potential is likely to fall. As a countermeasure, an elimination lamp may be used which comprises a mixture of fluorescent glow lamps 24 to each of which a blue filter is attached to emit a light less than 500 nm, and of the LEDs (TLG 102 made by Toshiba) each having the characteristic shown in FIG. 10. Stability is achieved by activating only the blue color light with temperatures higher than 35° C. and activating both of the lights at temperatures lower than 35° C.

Figure 11A:
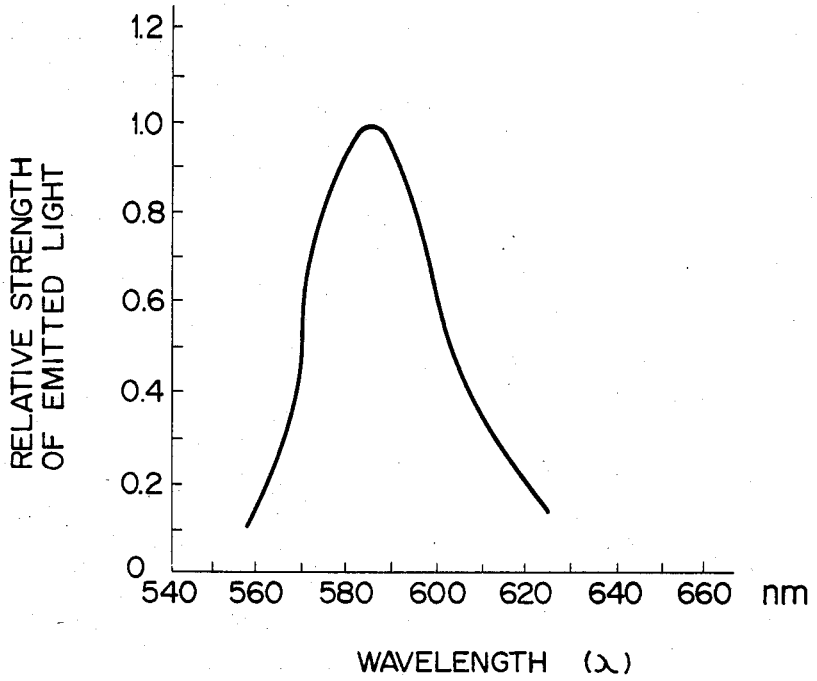
FIGS. 11A through 11C are charts showing the spectroradiation characteristics of another LED.
Figure 11B:
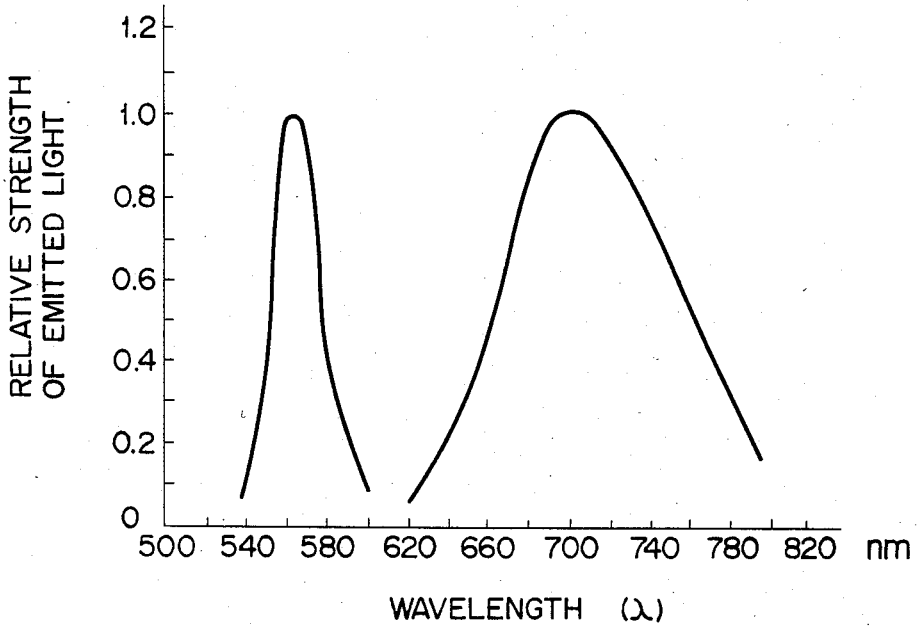
Figure 11C:
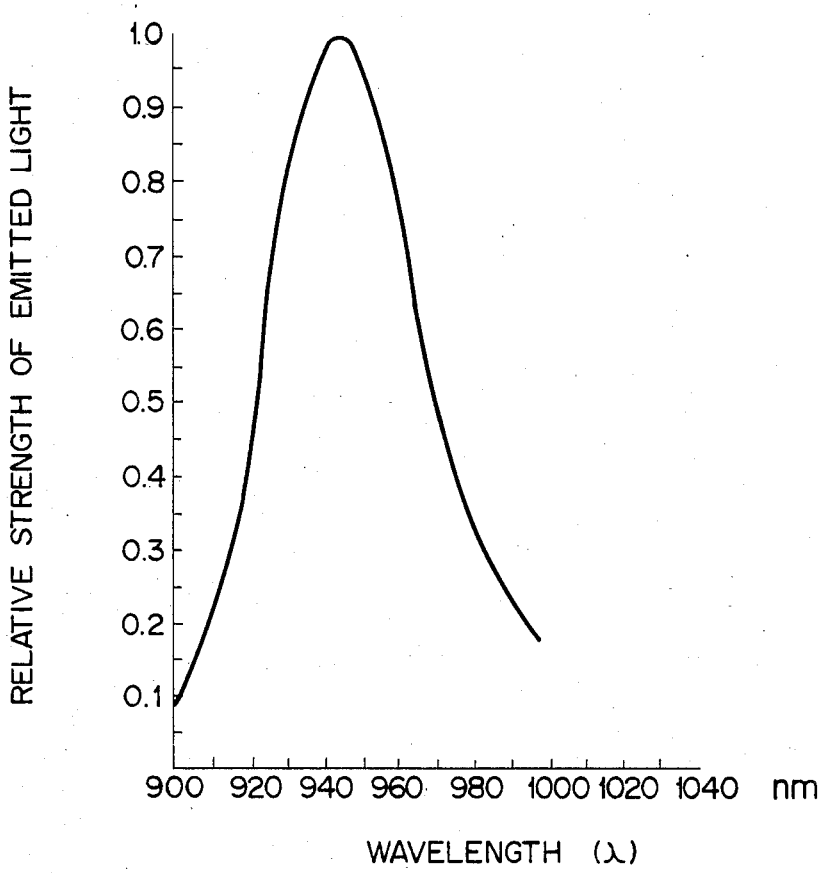
Figure 12A:
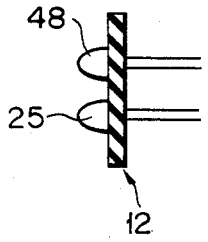
FIGS. 12A and 12B are sectional and front views showing the second uniform exposure device in the second embodiment according to the present invention.
Figure 12B:
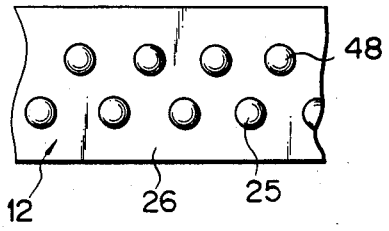

Characteristics are shown in FIGS. 11A to 11C relating to other LED light sources for radiating single color light which can correspond to other photosensitive drums. FIG. 11A shows the characteristic of the TLG 102 made by Toshiba, FIG. 11B that of a TLRG 101 made by Toshiba, and FIG. 11C that of a TLN 103 made by Toshiba. Red and green LEDs are unified in the case of the light source shown in FIG. 11B. The single color light used here does not represent only a single wavelength, but means a light distributed only at a specific wavelength area. In addition to the lights mentioned above, various kinds of single color lights can be obtained by combining optical filters with a white light source. When combined like this, it is possible to correspond to any other photosensitive drums of multi-layer type imagined. FIGS. 12A and 12B show a concrete example of the light source which is a combination of green LED (TLG 102) 48 and red LED (TLR 101) 25.

The photosensitive drum of the multi-layer type can be stabilized when it is arranged to have a relatively simpler construction as described above. Further, the wavelength and actuating mode of a single color light has no particular limitation. Furthermore, the number of the single color lights is not limited to two but should be changed depending upon the construction and characteristics of a photosensitive drum.

Figure 13:
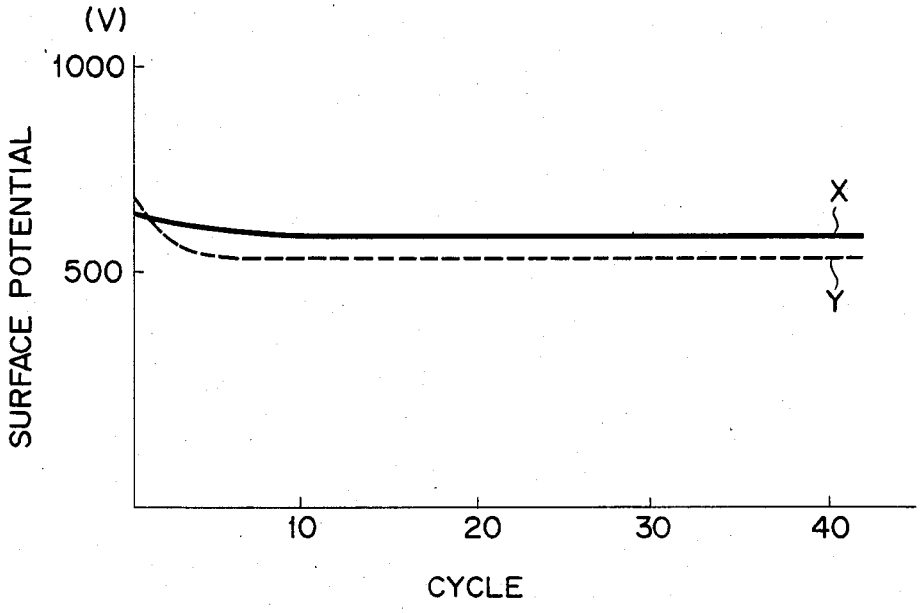
FIG. 13 is a chart showing a relationship between the number of cycles and the surface potential on the photosensitive body, in a third embodiment according to the present invention.

Plural lights each having a single color and a different spectral irradiation distribution are not used only for responding to environmental temperatures. It has been confirmed that the above-mentioned effect achieved by this embodiment can be further reinforced by gradually reducing the strength of irradiated light in continuous copying cycles. FIG. 13 shows an example of charge potential measured and represented by a property curve X and another property curve Y, the property curve X resulting from a case where Se-Te-Sb/Se-Te/Se/Al-based photosensitive drum 2 was used at 42° C. and where the irradiation amount of blue fluorescent glow lamp 24 was gradually reduced from 60 erg/cm$^2$ to 20 erg/cm$^2$ over 10 steps starting from first cycle and ending tenth cycle, and said another property curve Y resulting from a case where the irradiation amount of blue fluorescent glow lamp 24 is held certain, 30 erg/cm$^2$. These results teach us that initial change can be effectively reinforced.

Figure 14:
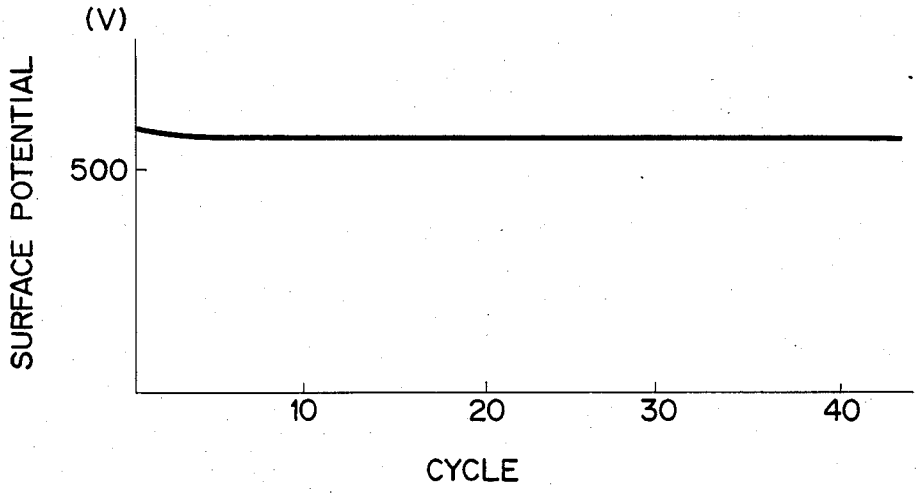
FIG. 14 is a chart showing a relationship between the number of cycles and the surface potential on the photosensitive body, in a fourth embodiment according to the present invention.

It may be arranged under continuous copying mode that only red LED 25 or both of blue fluorescent glow lamp 24 and red LED 25 is (or are) turned on in the course of several rotations of the drum at initial mode before the copying operation, and that only blue fluorescent glow lamp 24 is left turned on at the subsequent copying mode. Initially-forced fatigue is urged near saturation and lamps are then changed to irradiate such a wavelength as causes little fatigue, thereby enabling stable charge potential to be obtained. FIG. 14 shows an example of charge potential measured in this case. Both of blue fluorescent glow lamp 24 and red LED 25 were turned on, the drum rotated two times, at initial mode and their irradiation amount was about 80 erg/cm$^2$ at 42° C.

What is claimed is:

1. An electrophotographic device comprising:

a photosensitive body movable in one direction and including a grounded conductive base body, a first photosensitive layer arranged above the base body and having a spectral sensitivity ranging from short to long wavelength region, and a second photosensitive layer coated on the first photosensitive layer and having a spectral sensitivity belonging to the short wavelength region; and an exposing means located opposite to the photosensitive body to expose all over the photosensitive body as it moves along the one direction, said exposing means including a first exposing unit having a spectral irradiation characteristic of long wavelength light, a second exposing unit having a spectral irradiation characteristic of short wavelength light, a driving means for selectively turning on the plural exposing units, a detector means for detecting the environmental temperature of said photosensitive body to generate a detection signal, and a control means connected to the driving means and serving to control the driving means to selectively turn on the first and second exposing units, responsive to the detection signal applied from the detector means.

2. An electrophotographic device according to claim 1, wherein said first exposing unit has a red single color light source and said second exposing unit has a blue single color light source.

3. An electrophotographic device according to claim 2, wherein said red single color light source is located adjacent to the blue single color light source.

4. An electrophotographic device according to claim 1, wherein said control means causes the driving means to turn on both of the first and second exposing units in a case where the control means judges according to the detection signal that the environmental temperature of the photosensitive body is lower than a first reference temperature; wherein said control means causes the driving means to turn on only the first exposing unit in a case where the control means judges that the environmental temperature of the photosensitive body is between the first reference temperature and a second reference temperature which is higher than the first reference temperature; and wherein said control means causes the driving means to turn on only the second exposing unit in a case where the control means judges that the environmental temperature is higher than the second reference temperature.

* * * * *